United States Patent [19]

Yasuzuka

[11] Patent Number: 4,588,894

[45] Date of Patent: May 13, 1986

[54] VACUUM TUBE AND A METHOD FOR MANUFACTURING THE SAME

[75] Inventor: Takezou Yasuzuka, Yokohama, Japan

[73] Assignee: Kabushiki Kaisha Toshiba, Kawasaki, Japan

[21] Appl. No.: 681,143

[22] Filed: Dec. 13, 1984

[30] Foreign Application Priority Data

Dec. 19, 1983 [JP] Japan ..... 58-239389

[51] Int. Cl.[4] ..... H01J 35/18

[52] U.S. Cl. ..... 250/483.1; 219/118

[58] Field of Search ..... 219/118, 91.2, 111; 250/483.1, 213 VT; 313/420

[56] References Cited

U.S. PATENT DOCUMENTS

| | | | |
|---|---|---|---|
| 3,406,304 | 10/1968 | Breuster | 313/420 |
| 3,878,417 | 4/1975 | Eberlzin | 313/420 |
| 4,122,967 | 10/1978 | Röhrich | 313/420 |
| 4,213,055 | 7/1980 | Schrijvers et al. | 250/483.1 |
| 4,423,351 | 12/1983 | Sugimori et al. | 313/523 |
| 4,433,230 | 2/1984 | Sano et al. | 219/118 |

FOREIGN PATENT DOCUMENTS

| | | |
|---|---|---|
| 2077169 | 12/1981 | United Kingdom . |
| 2234655 | 1/1975 | France . |
| 58-7010 | 2/1983 | Japan . |
| 940352 | 2/1947 | France . |

*Primary Examiner*—Bruce C. Anderson
*Assistant Examiner*—Paul A. Guss
*Attorney, Agent, or Firm*—Cushman, Darby and Cushman

[57] ABSTRACT

In a vacuum tube with a window through which radiation is passed, an entrance window member is formed of radiation transparent metal, such as titanium or a titanium-base alloy. An entrance window supporting frame, which defines the window, is formed of iron or an alloy containing iron. The flat inner surface of the entrance window member is tacked to the flat outer surface of the entrance window supporting frame along the whole perimeter thereof by tack welding. An intermediate member formed of a metal containing gold or silver is interposed between the respective peripheral edge portions of the entrance window member and the entrance window supporting frame, whereby the entrance window member is finally welded to the peripheral edge portion of the entrance window supporting frame along the whole perimeter thereof in a vacuum-tight manner by continuous spot welding. The position for the final welding is at a predetermined distance from the weld zone of the tack welding. The tack welding permits continuous spot welding with use of the intermediate member without variations of welding conditions in the weld zone.

9 Claims, 5 Drawing Figures

VACUUM TUBE AND A METHOD FOR MANUFACTURING THE SAME

BACKGROUND OF THE INVENTION

The present invention relates to a vacuum tube with an entrance window for transmitting radiation such as an X-ray image intensifier tube, X-ray tube, radiation detector, betatron doughnut tube, etc., and a method for manufacturing the same.

Conventionally, vacuum tubes of this type have an entrance window through which radiation is passed and have a vacuum-tight structure such that a vacuum or a predetermined gas atmosphere is kept therein. In an X-ray image intensifier tube, for example, its entrance window has a large diameter of approximately 150 to 400 mm, and X-rays transmitted through an object of detection are introduced through the entrance window. The entrance window is formed not of glass whose rates of X-ray absorption and scattering are relatively high, but of aluminum or titanium. In an X-ray tube using a metal as a material for its central portion, an exit window needs to be located very close to an anode target, which is liable to be increased in temperature and to emit secondary electrons. Therefore, the exit window must withstand a very high temperature. Under this condition, titanium or a titanium-base alloy (all of these materials are hereinafter referred to as titanium-base material) is practically used as a metal material which has low rates of radiation absorption and scattering and high resistance against atmospheric pressure.

The vacuum tubes of this type, however, partially consist of an insulator such as glass or ceramics. The insulator is used because it is necessary that various internal electrodes be supported in the vacuum tubes, lead wires be led out of the vacuum tubes, and visible light images be transmitted to the outside of the vacuum tubes. Even if the insulator is not used for any part of the vacuum tubes, they are seldom formed of titanium-base material only. In general, the vacuum tubes are formed by joining a titanium-base material, and the vacuum tubes have an envelope which is formed by another metal material in a vacuum-tight manner at least at one portion thereof. Kovar (trademark), stainless steel, iron as a high-permeability material, or an alloy containing iron (all of these materials are hereinafter referred to as iron-base material) is often used for the metal material. The iron-base material can stably be joined with glass or ceramics.

A method of joining titanium-base material to iron-base material in a vacuum-tight manner in one such conventional vacuum tube is disclosed in Japanese Patent Disclosure No. 3340/82.

The vacuum tube manufactured by this conventional vacuum-tight welding method comprises an entrance window member for radiation transmission and an entrance window supporting frame joined to the peripheral edge portion of the entrance window member in a vacuum-tight manner. The entrance window member is formed of a titanium-base material, while the entrance window supporting frame is formed of an iron-base material. An intermediate member is interposed between the peripheral edge portion of the entrance window member and the entrance window supporting frame. The intermediate member is formed of silver solder, gold solder or other metal material which melts at a temperature lower than the critical temperature of the entrance window member. The entrance window member and the entrance window supporting frame are joined together by spot welding through the medium of the intermediate member.

According to this prior art joining method, the intermediate member is interposed between the entrance window member and the entrance window supporting frame. A composite structure as an object of welding consisting of the entrance window member, the intermediate member, and the entrance window supporting frame is inserted between a pair of electrodes of a spot welding machine. A pressure ranging from 40 to 200 $kg/cm^2$ and a pulse current of 5,000 to 40,000 $A/cm^2$ are applied between the two electrodes. During intermission of the conduction, the joint of the object of welding is moved a given distance along the periphery of the entrance window member for spot welding. Thus, the entrance window supporting frame and the entrance window member, along with the intermediate member between them, are joined in a vacuum-tight manner along the whole perimeter of the window.

The prior art vacuum-tight joining method, however, involves various problems related to a tack welding step. If the entrance window member is formed of a flat titanium-base material, it needs to be previously tacked to the entrance window supporting member before a final welding step. This is so because the flat titanium-base material, without the tack welding steps, would be bent by thermal expansion during the final welding process. For example, the tack welding is either diagonally performed at four corners or alternately performed at 16 spots which include the four corner portions of the entrance window member and are arranged at regular intervals along its periphery. After the tack welding step, the final welding is conducted to cover the whole perimeter of the window including the tacked spots. The intermediate member is oxidized due to the tack-welding. Therefore, if these tacked regions are welded again by the final spot welding, they can provide less weld strength between the entrance window member and the entrance window supporting frame than the non-tacked regions between them. Thus, the vacuum-tight structure of the vacuum tube is lowered in reliability. Moreover, the intermediate member is melted by the tack welding, so that it will lack or become too thin in some positions to undergo the final spot welding. Accordingly, the tacked regions are different in welding conditions from the non-tacked regions. The difference in welding conditions causes splashes on either side of the intermediate member, which will be scattered into the vacuum tube to soil it.

SUMMARY OF THE INVENTION

The first object of the present invention is to provide a vacuum tube obviating the above-mentioned drawbacks of the prior art vacuum tube and ensuring a highly stable vacuum-tight structure without splashes therein.

The second object of the invention is to provide a method for manufacturing the aforesaid vacuum tube with high reliability and with ease.

According to the invention, there is provided a vacuum tube with a window through which radiation is passed. The vacuum tube comprises a first member made of radiation transparent metal having a flat inner surface in the vicinity of the peripheral edge portion thereof and adapted to cover the window in a vacuum-tight manner, and a second member having a flat outer surface in the vicinity of the peripheral edge portion of the window. The flat outer surface of the second member is tacked to the flat inner surface of the first member along the whole perimeter thereof by tack welding. The vacuum tube further comprises an intermediate member interposed between the respective peripheral edge portions of the first and second members. With use of the intermediate member, the second member is finally welded to the peripheral edge portion of the first member along the whole perimeter thereof in a vacuum-tight manner by continuous spot welding. The position for the final welding is located outside the weld zone of the tack welding at a predetermined distance therefrom.

With this arrangement, the vacuum tube can enjoy a stable vacuum-tight structure without splashes attributed to the use of the intermediate member, especially because the tack welding permits the weld zones including the intermediate member to be continuously joined by spot welding without any variations in welding conditions.

According to the invention, moreover, there is provided a method for manufacturing a vacuum tube with a window for transmitting radiation. The vacuum tube includes a first member for covering the window in a vacuum-tight manner and a second member defining the window. The method comprises an insertion step for inserting the first member, an intermediate member, and the second member between a pair of electrodes of a spot resistance welding machine. The intermediate member is superposed on the peripheral edge portion of the second member between a flat inner surface at the peripheral edge portion of the first member and a flat outer surface of the second member in the vicinity of the peripheral edge portion thereof. Then, the flat inner surface of the first member and the flat outer surface of the second member are tacked along the whole perimeter of the second member at a position located inside the position for the insertion of the intermediate member at a predetermined distance therefrom. This tack welding step includes tack welding using a predetermined pressure and a continuous pulse current for proper heating. Thereafter, the first member, the intermediate member, and the second member are joined in a vacuum-tight manner along the whole perimeter of the second member at the position where the intermediate member is inserted. This final welding step includes spot welding using a predetermined pressure and a continuous pulse current for proper heating.

According to this method of the invention, the tack welding process permits highly stable, continuous final welding. Moreover, the vacuum tube manufactured by this method is prevented from containing therein splashes attributed to the use of the intermediate member.

DETAILED DESCRIPTION OF THE PREFERRED EMBODIMENTS

Figure 1:
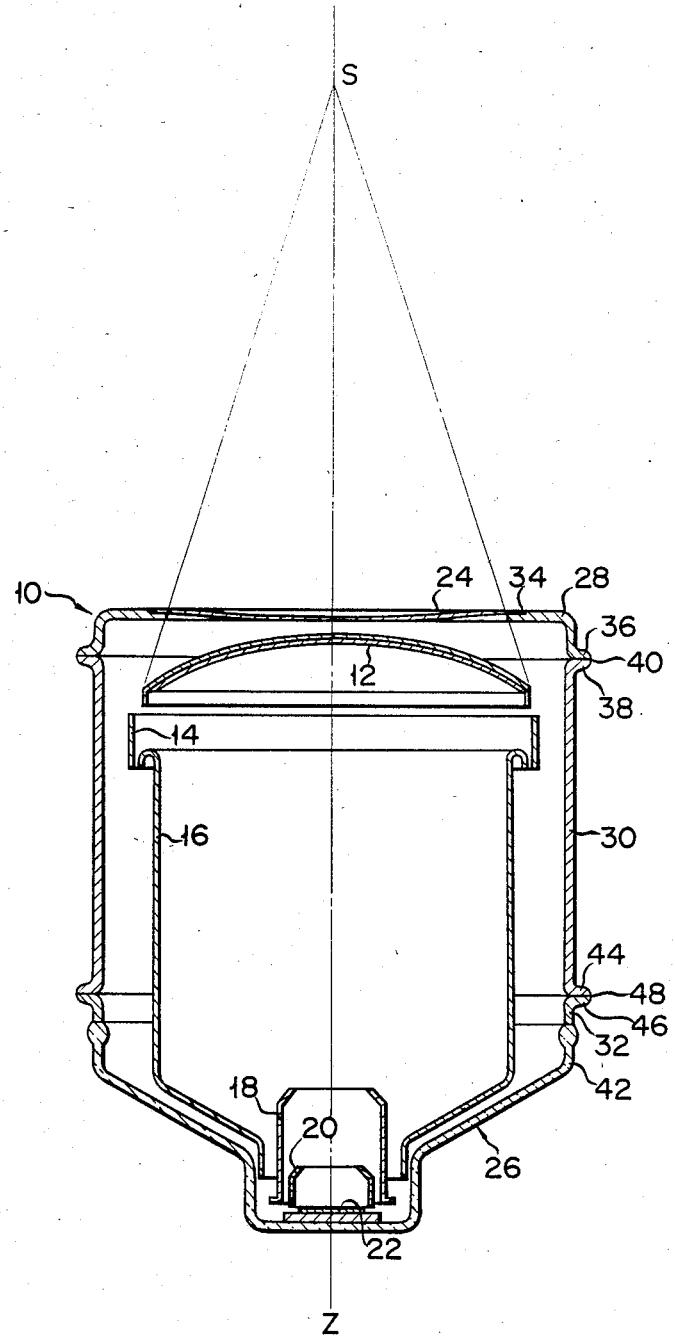
FIG. 1 is a longitudinal sectional view schematically showing an X-ray image intensifier tube according to one embodiment of the present invention.
Figure 2:
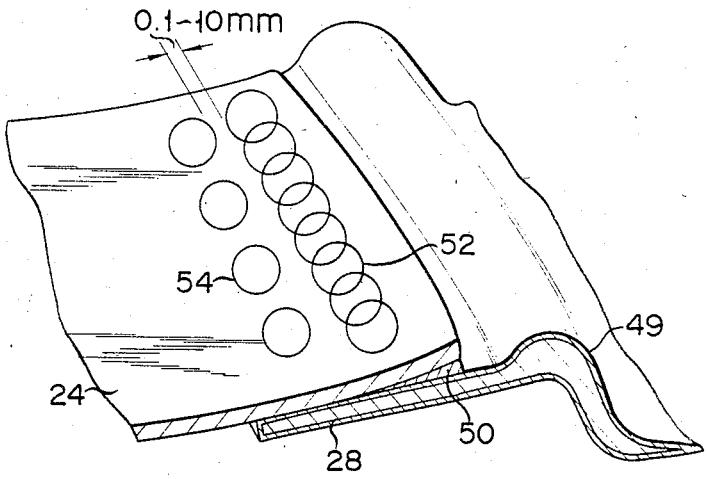
FIG. 2 is a perspective view partially in section illustrating the principal part of the X-ray image intensifier tube shown in FIG. 1.
Figure 3:
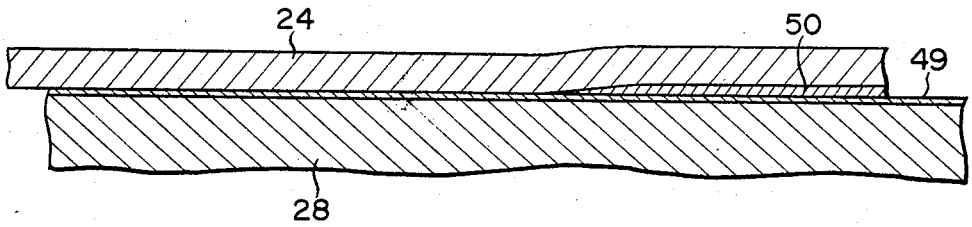
FIG. 3 is an enlarged sectional view of the principal part shown in FIG. 2.

Referring now to FIGS. 1 to 3, there will be described an embodiment of the present invention which is embodied in an envelope of an X-ray image intensifier tube.

FIG. 1 is a schematic sectional view of the X-ray image intensifier tube. The X-ray image intensifier tube has an envelope 10 in which are arranged a spherical entrance detection screen 12 including a luminescent screen layer formed of, e.g., cesium iodide and a photocathode layer, a cylindrical first grid 14, a cylindrical second grid 16, a cylindrical third grid 18, an anode 20, and an electron-sensitive exit screen 22. The envelope 10 includes an entrance window member 24 through which X-rays radiated from above (FIG. 1) are transmitted to reach the entrance detection screen 12, an exit section jacket 26 formed of glass and adapted to transmit a visible image formed on the electron-sensitive exit screen 22 to the outside of the X-ray image intensifier tube, a ring-shaped entrance window supporting frame 28, a cylindrical jacket 30, and a glass sealing ring 32 formed of Kovar (trademark). The last three members 28, 30 and 32 cooperatively connect the entrance window member 24 and the exit section jacket 26 in succession.

The X-ray image intensifier tube is manufactured in the following manner.

First, the entrance window member 24 and the entrance window supporting frame 28 are joined at a joint 34 in a vacuum-tight manner along the whole perimeter with the aid of an intermediate member 50 mentioned later. This joining step will be described in detail later. Then, an outwardly extending flange 36 of the entrance window supporting frame 28 and an outwardly extending flange 38 of the cylindrical jacket 30 are joined at a joint 40 in a vacuum-tight manner by arc welding using inert gas. An open end portion 42 of the exit section jacket 26 and the ring 32 are welded together beforehand. After the individual electrodes are built in the envelope 10, a lower flange 44 of the cylindrical jacket 30 and a flange 46 of the ring 32 are finally joined at a joint 48 in a vacuum-tight manner along the whole perimeter by arc welding using inert gas. Thus, the envelope 10 is hermetically closed. According to this manufacturing method, the finally sealed joint 48 between the lower flange 44 of the cylindrical jacket 30 and the flange 46 of the ring 32 is located far enough from the entrance window member 24 and the entrance detection screen 12, so that the envelope 10 can be fabricated without unnecessarily heating the entrance window member 24 and the entrance detection screen 12 at the time of arc welding.

The cylindrical jacket 30 is formed of a metal which can easily be welded to the ring 32 and the entrance window supporting frame 28, e.g., nonmagnetic stainless steel, a high-permeability metal material such as permalloy (containing 27% iron, 5% molybdenum, and nickel for the remains), or iron, or an alloy containing iron with high permeability. The entrance window supporting frame 28 is formed of one of those metal materials mentioned above or a nonmagnetic metal material (all of these materials is hereinafter referred to as iron-base material). Preferably, the nonmagnetic metal material should be a metal which cannot be magnetized or deformed by a magnetizing force at the time of pressing operation which is accompanied with heat produced by resistance attributed to a high pulse current. The material for the entrance window member 24 may be titanium or an alloy of titanium and one or some of minority metals including aluminum, molybdenum, chromium, tin, manganese, vanadium, etc. (all of these materials is hereinafter referred to as titanium-base material).

The vacuum-tight structure of the joint between the entrance window supporting frame 28 of the iron-base material and the entrance window member 24 of the titanium-base material will be described in detail.

As shown in FIG. 2, the entrance window member 24 is in the form of a flat plate with a thickness of 0.1 to 0.5 mm, preferably 0.25 mm. The entrance window supporting frame 28 is substantially crank-shaped in cross section, and has a thickness of 1 to 3 mm, preferably 2 mm. The entrance window supporting frame 28 is previously plated with nickel all over the outer surface, and thereby a nickel layer 49 is formed on the outer surface of the entrance window supporting frame 28. As shown in FIGS. 2 and 3, the entrance window member 24 and the entrance window supporting frame 28 are joined in a vacuum-tight manner through the medium of the intermediate member 50. More specifically, the respective peripheral edge portions of the entrance window member 24 and the entrance window supporting frame 28 are joined in a vacuum-tight manner along the periphery of the entrance window member 24 by continuous spot welding, as indicated by spots 52 in FIG. 2. The intermediate member 50 is 0.5 mm or less in thickness and 10 mm or less in width. The intermediate member 50 is formed of a gold- or silver-base alloy containing copper. The critical temperature of the intermediate member 50 is lower than that of the titanium-base material (approx. 800° to 950° C.) and higher than the maximum temperature 550° C., reached during the manufacture and use of the product. Also, the respective flat surfaces of the peripheral edge portions of the entrance window frame 24 and the entrance window supporting frame 28 are previously tacked by tack welding, as indicated by spots 54 in FIG. 2. The weld zone of the tack welding is located inside that of the final spot welding at a distance of 0.1 to 10.0 mm therefrom.

The position for the tack welding will now be explained.

In FIG. 1, broken lines indicate a cone of X-rays radiated from an X-ray source S to the entrance detection screen 12. In general, the radial distance from a tube axis Z to the joint 34 is substantially equal to the distance from the tube axis Z to the edge of the entrance detection screen 12. Thereupon, the joint 34 is located at a given radial distance from the window, and the X-ray cone does not cover those portions of the entrance window member 24 and the entrance window supporting frame 28 which extend from the joint 34 between them to the edge of the entrance window supporting frame 28. Therefore, those excluded portions of the entrance window member 24 and the entrance window supporting frame 28 can be effectively used for the tack welding.

Since the tack welding permits the entrance window member 24 and the entrance window supporting frame 28 to be directly partially welded together along the circumferential direction, no gap is formed between the two members 24 and 28. Thus, the envelope 10 contains no splashes therein. Moreover, the weld zone including the intermediate member 50 is continuously joined by spot welding, so that the vacuum tube can enjoy stable gastightness. According to a brine spraying test for the comparison of gastight time between the prior art vacuum tube and the vacuum tube according to the invention, it is indicated that the gastight time of the later is 1,000 hours or more as compared with approximately 170 hours for the former.

The seam welding is considered as the method for joining the entrance window member 24 to the entrance window supporting frame 28. In the method of seam welding, however, if the titanium-base material is circular in shape, its elongated portions, due to thermal expansion, cannot easily be relieved, resulting in wrinkles in the material which would cause leakage. According to a method of the present invention, therefore, the spot welding is adapted to joining the entrance window member 24 to the entrance window supporting frame 28.

There will now be described the manufacturing method of the invention in which the entrance window supporting frame 28 and the entrance window member 24 are joined by spot welding.

The intermediate member 50 is interposed between the entrance window member 24 and the entrance window supporting frame 28 so that the respective peripheral edge portions of the entrance window supporting frame 28 and the intermediate member 50 overlap each other. The entrance window supporting frame 28, the intermediate member 50, and the entrance window member 24 are inserted between a pair of electrodes of a spot welding machine. The respective flat surfaces of the peripheral edge portions of the entrance window supporting frame 28 and the entrance window member 24, which are free of the interposition of the intermediate member 50, are first tacked together by tack welding. In this tack welding, the weld zone is subjected to a pressure of 40 to 200 kg/cm$^2$ and a flow of a pulse current of 4,000 to 36,000 A/cm$^2$. This pulse current is applied at a frequency of 3 to 20 Hz for 0.5 to 3 seconds for each of the pressure weld spots 54. As shown in FIG. 2, the pressure weld spots 54 are intermittently formed at regular intervals along the whole perimeter of the entrance window member 24. Then, the respective peripheral edge portions of the entrance window supporting frame 28 and the entrance window member 24 are spot-welded in a vacuum-tight manner with the aid of the intermediate member 50. In this final welding step, the weld zone is subjected to a pressure of 40 to 200 kg/cm$^2$ and a flow of a pulse current of 5,000 to 40,000 A/cm$^2$. This pulse current is applied at a frequency of 3 to 20 Hz for 0.5 to 3 seconds for each of the pressure weld spots 52. In this case, the pressure weld spots 52 overlap one another to be substantially continuous along the whole perimeter of the entrance window member 24, as shown in FIG. 2. The pressure weld spots 52 are arranged at pitches such that the width of each overlap is a fourth to third of the diameter of the contact surface of each electrode. In this case, the final welding is performed apart from the tacked spots 54 at a distance of 0.1 to 10 mm.

In the method for manufacturing the vacuum tube according to the present invention, the entrance window member 24 formed of a titanium-base material susceptible to thermal expansion can be accurately positioned relatively to the entrance window supporting frame 28 by tack welding. Further, the entrance window member 24 is prevented from being deformed by slackening.

According to the manufacturing method of the invention, moreover, the intermediate member 50 is not used in tacking the entrance window member 24 and the entrance window supporting frame 28, so that it will not suffer melting or other deformation, is involved in the conventional tack welding step. Thus, the final welding can be continuously performed with high stability.

According to the manufacturing method of the invention, as shown in FIG. 2, the tacked spots are located close to the window, so that the surplus thickness portion of the intermediate member 50 melted in the final welding process extends not on either side thereof, but outward from the vacuum tube. As shown in FIG. 3, moreover, the tack welding allows no gap to be formed between the entrance window member 24 and the entrance window supporting frame 28, thereby preventing splashes from entering the vacuum tube.

Figure 4:
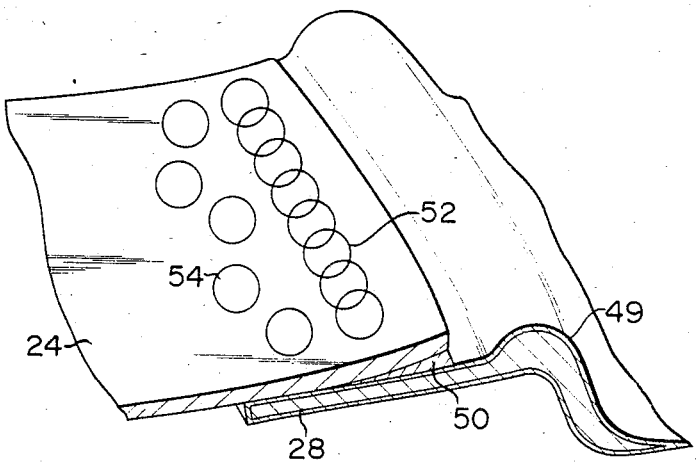
FIGS. 4 and 5 are perspective views similar to FIG. 2 illustrating varied manners of tack welding different from the way shown in FIG. 2.
Figure 5:
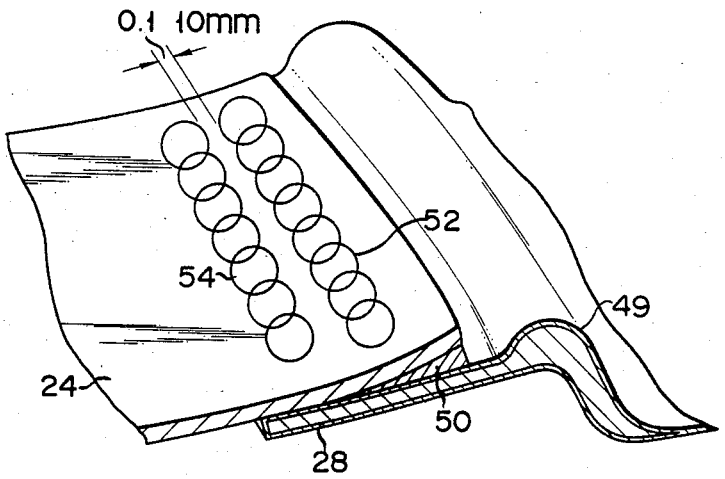

According to the manufacturing, furthermore, the intervals between the tack weld spots and the position of the tack weld zone may be freely set in accordance with the shape of the entrance window or the like. For example, FIGS. 4 and 5 show methods of tack welding different from the one shown in FIG. 2. In FIGS. 4 and 5, like reference numerals refer to the same parts as used in the embodiment shown in FIGS. 1 to 3.

In the embodiment shown in FIG. 4, the entrance window member 24 and the entrance window supporting frame 28 are tacked in zigzags along the peripheral edge of the window so that the weld spots are arranged at alternately long and short distances from the peripheral edge. This tack welding process may include two steps.

In the embodiment shown in FIG. 5, as in the embodiment shown in FIG. 2, the tack welding is performed along the circumference of the window. In this case, however, the tacked spots 54 overlap one another in the same manner as the final weld spots 52.

In the embodiments shown in FIGS. 4 and 5, the tack welding provides the same effect as that obtained in the embodiment shown in FIGS. 1 to 3, ensuring an improved the connecting between the entrance window member 24 and the entrance window supporting frame 28.

What is claimed is:

1. A vacuum tube with a window through which radiation is passed, comprising:

a first member made of radiation transparent metal, having a flat inner surface in the vicinity of the peripheral edge portion thereof, and adapted to cover the window in a vacuum-tight manner;

a second member having a flat outer surface in the vicinity of the peripheral edge portion of the window, the flat outer surface of said second member being tacked to the flat inner surface of the first member along the whole perimeter thereof by tack welding; and an intermediate member interposed between the respective peripheral edge portions of the first and second members, whereby the second member is finally welded to the peripheral edge portion of the first member along the whole perimeter thereof in a vacuum-tight manner by continuous spot welding, so that the position for the final welding is located outside the weld zone of the tack welding at a predetermined distance therefrom.

2. The vacuum tube according to claim 1, wherein said first member is formed of titanium or a titanium-base alloy, and said second member is formed of iron or an alloy containing iron.

3. The vacuum tube according to claim 2, wherein said tack welding is performed substantially along the circumference of the window, whereby weld spots of the tack welding between the first and second members are arranged substantially parallel to those of the final welding along the whole circumference.

4. The vacuum tube according to claim 2, wherein said tack welding is performed in zigzags so that weld spots of the tack welding are arranged at alternately long and short distances from the weld zone of the final welding, whereby the weld spots of the tack welding between the first and second members are arranged substantially parallel to those of the final welding.

5. A method for manufacturing a vacuum tube with a window for transmitting radiation which includes a first member for covering the window in a vacuum-tight manner and a second member defining the window, comprising:

an insertion step for inserting the first member, an intermediate member, and the second member between a pair of electrodes of a spot resistance welding machine, said intermediate member being interposed on the peripheral edge portion of the second member between a flat inner surface at the peripheral edge portion of the first member and a flat outer surface of the second member in the vicinity of the peripheral edge portion thereof;

a tack welding step for joining the flat inner surface of the first member and the flat outer surface of the second member along the whole perimeter thereof and at a position located inside the position for the insertion of the intermediate member at a predetermined distance therefrom, said tack welding step including tack welding using a predetermined pressure and a continuous pulse current for proper heating; and a final welding step for joining the first member, the intermediate member, and the second member in a vacuum-tight manner at the position where the intermediate member is inserted, said final welding step including continuous spot welding using a predetermined pressure and a continuous pulse current for proper heating.

6. The method according to claim 5, wherein said first member is formed of titanium or a titanium-base alloy, and said second member is formed of iron or an alloy containing iron.

7. The method according to claim 6, wherein a pressure of 40 to 200 kg/cm$^2$ and a pulse current of 4,000 to 36,000 A/cm$^2$ are used in tack welding in said tack welding step.

8. The method according to claim 7, wherein said tack welding in said tack welding step is performed substantially along the whole circumference of the window, whereby weld spots of the tack welding are arranged substantially parallel to those of the final welding along the whole circumference.

9. The method according to claim 7, wherein the tack welding in said tack welding step is performed in zigzags so that weld spots of the tack welding are arranged at alternately long and short distances from the weld zone of the final welding.

* * * * *